US005938896A

United States Patent [19]

Graf

[11] Patent Number: 5,938,896

[45] Date of Patent: Aug. 17, 1999

[54] HYDRAULIC INCREASER FOR A WET END OF A PAPER-MAKING MACHINE

[75] Inventor: Edwin X. Graf, Menasha, Wis.

[73] Assignee: Voith Sulzer Paper Technology North America, Inc., Appleton, Wis.

[21] Appl. No.: 08/940,852

[22] Filed: Sep. 30, 1997

[51] Int. Cl.[6] ..... D21F 1/02

[52] U.S. Cl. ..... 162/336; 162/343

[58] Field of Search ..... 162/336, 338, 162/343, 258

[56] References Cited

U.S. PATENT DOCUMENTS

| | | | |
|---|---|---|---|
| 3,945,882 | 3/1976 | Egelhof et al. | 162/336 |
| 4,285,767 | 8/1981 | Page | 162/216 |
| 5,030,326 | 7/1991 | Nous | 162/343 |
| 5,147,509 | 9/1992 | Kuragasaki et al. | 162/343 |
| 5,277,765 | 1/1994 | Graf et al. | 162/342 |
| 5,423,948 | 6/1995 | Graf et al. | 162/342 |
| 5,510,005 | 4/1996 | Gingerich | 162/343 |

*Primary Examiner*—Karen M. Hastings
*Attorney, Agent, or Firm*—Taylor & Associates, P.C.

[57] ABSTRACT

A wet end of a paper-making machine, including a headbox with a chamber and a discharge nozzle. A turbulence generator is connected with the headbox and includes a plurality of fluid passages disposed substantially parallel to each other. Each fluid passage is in fluid communication with the headbox chamber and has an inlet. All of the inlets conjunctively define a fluid inlet area. A fiber stock delivery device includes at least one outlet, with all of the outlets conjunctively defining a fluid discharge area. Each outlet is configured to discharge the fiber stock in a direction substantially parallel to the fluid passages in the turbulence generator. The fluid discharge area of the fiber stock delivery device is smaller than the fluid inlet area of the turbulence generator. A hydraulic increaser interconnects the fluid discharge area of the fiber stock delivery device with the fluid inlet area of the turbulence generator. The hydraulic increaser includes at least two interior abutting surfaces, with each abutting surface having at least one end defining an adjoining edge with another said abutting surface. Each abutting surface defines a line at each end which is disposed tangent to the abutting surface at the respective end. Each tangent line defines an acute angle with a tangent line of an adjacent abutting surface which is between approximately 1° and 10° preferably not greater than approximately 4°.

25 Claims, 4 Drawing Sheets

HYDRAULIC INCREASER FOR A WET END OF A PAPER-MAKING MACHINE

BACKGROUND OF THE INVENTION

1. Field of the Invention

The present invention relates to paper-making machines, and, more particularly, to a wet end of a paper-making machine.

2. Description of the Related Art

A wet end of a paper-making machine partially includes a headbox, a wire and a former associated with the wire. The headbox receives prepared fiber stock in the form of a prepared fiber suspension. The headbox has a nozzle section which extends substantially across the width of the wire and the fiber stock is discharged with a known cross sectional profile from the nozzle section onto the wire.

It is known to provide a turbulence generator at the inlet to the headbox. The turbulence generator assists in deflocculating the fiber stock which enters the headbox. For example, referring to FIG. 1, it is known to provide a turbulence generator in the form of a diffuser plate which is attached to the inlet of the headbox. The diffuser plate includes a plurality of through holes which are disposed substantially parallel to each other and extend in the flow direction toward the inlet of the headbox. The diffuser plate provides a more even flow distribution of the fiber stock which is transported into the headbox and assists in deflocculating the fiber stock. The diffuser plate may be connected in a conventional manner with a tapered header. The taper angle on the tapered header is selected such that the velocity decrease caused by fiber stock flowing through the through holes in the diffuser is substantially offset by the velocity increase caused by the reduced cross sectional area associated with the taper angle, thereby resulting in a substantially constant flow rate into the headbox across the diffuser plate.

It is also known to provide a turbulence generator in the form of a tube bundle including a plurality of tubes which are connected at one end thereof to the headbox inlet, and connected at the other end thereof to a source of fiber stock. A tube bundle of this type also assists in deflocculating the fiber stock entering the headbox inlet. Such a tube bundle is incorporated into the "VALLEY" headbox marketed by the assignee of the present invention.

It is further known to control "on the fly" the concentration of the fiber stock which is transported into a headbox. Varying the concentration of the fiber stock immediately prior to the fiber stock entering the headbox inlet is known as "dilution control". For example, with a headbox including a diffuser plate with a plurality of through holes as described above, it is known to inject clean water into the fiber stock flowing through a particular through hole to thereby dilute the fiber stock to a particular concentration. A problem with using clean water for dilution control in this manner is that the clean water is obtained from a source, such as well water, having a temperature and Ph which are different from the fiber stock flowing through the associated through hole in the diffuser plate. Thus, heat and/or chemicals may need to be added to the clean water to obtain the proper temperature and Ph. A more significant problem is that the introduction of clean water into the flow of fiber stock which is flowing through a through hole in the diffuser plate causes a local increase in the flow rate of the fiber stock which flows through the headbox. This local flow rate generally is transmitted to the nozzle, resulting in a localized increased flow rate of the fiber stock from the nozzle which is undesirable.

It is also known to provide dilution control in conjunction with a conventional hydraulic headbox. For example, it is known to provide a relatively large tapered header through which headbox consistency fiber stock flows. The headbox consistency fiber stock is transported from the larger tapered header through a plurality of fluid passages. A smaller tapered header carries lean whitewater which is recirculated from the portion of the wet end associated with the wire and former(s). The lean whitewater is primarily water which has drained from the fiber stock carried on the wire in the wet end, but also includes a small amount of fibers therein. The lean whitewater is substantially at the correct temperature and Ph since it has already been treated prior to being previously introduced into the headbox. The lean whitewater is transported from the smaller tapered header through a plurality of fluid passages which respectively merge with the fluid passages associated with the larger tapered header. Depending upon the angle between each pair of merging fluid passages and the flow rate of the lean whitewater through the fluid passages, the main flow through the fluid passages associated with the larger tapered header may be somewhat retarded to provide dilution control without increasing the flow rate from each fluid passage. Such a dilution control apparatus thus provide effective dilution control without changing the localized flow rate of the fiber stock flowing through the headbox. A dilution control apparatus of this type is marketed by the assignee of the present invention under the trademark "MODULE JET".

Heretofore, the MODULE JET dilution control apparatus as described above has not been used in conjunction with a headbox with a turbulence generator as described above. More particular, the fluid passages associated with the module jet dilution control apparatus define an outlet with a row of essentially aligned outlet holes extending across the width of the module jet. The cross sectional area of the outlet for the module jet is thus relatively small. On the other hand, the various through holes or tubes in a diffuser or tube bundle, respectively, include inlets which are spaced relatively far apart in order to prevent "stapling" or buildup of the fibers on the lands between the through holes or tubes. Thus, the inlet area to a turbulence generator in the form of a diffuser or a tube bundle is substantially larger than the outlet of the module jet dilution control apparatus.

The module jet dilution control apparatus as described above also allows for "fiber orientation" of the fiber stock which is discharged from the nozzle of the headbox onto the wire of the wet end. In general, fiber orientation is the direction which each fiber generally extends relative to the running direction of the machine when the fiber stock is discharged onto the wire. It has been found to be preferable to orient the fibers of the fiber stock on the wire at a relatively small acute angle relative to the machine running direction. The module jet fiber orientation apparatus has been found to be effective in providing fiber orientation of the fiber stock on a wire as well as dilution control.

What is needed in the art is a device which allows a fiber stock delivery device providing both dilution control and fiber orientation to be used in conjunction with a headbox having a turbulence generator, without adversely affecting the flow characteristics of the fiber stock which is discharged from the headbox onto the wire of the paper-making machine.

SUMMARY OF THE INVENTION

The present invention provides a hydraulic increaser which interconnects a smaller fluid discharge area of a fiber stock delivery device with a larger fluid inlet area of a turbulence generator associated with a headbox, without causing flow separation of the fiber stock flowing therethrough.

The invention comprises, in one form thereof, a wet end of a paper-making machine, including a headbox with a chamber and a discharge nozzle. A turbulence generator is connected with the headbox and includes a plurality of fluid passages disposed substantially parallel to each other. Each fluid passage is in fluid communication with the headbox chamber and has an inlet. All of the inlets conjunctively define a fluid inlet area. A fiber stock delivery device includes at least one outlet, with all of the outlets conjunctively defining a fluid discharge area. Each outlet is configured to discharge the fiber stock in a direction substantially parallel to the fluid passages in the turbulence generator. The fluid discharge area of the fiber stock delivery device is smaller than the fluid inlet area of the turbulence generator. A hydraulic increaser interconnects the fluid discharge area of the fiber stock delivery device with the fluid inlet area of the turbulence generator. The hydraulic increaser includes at least two interior abutting surfaces, with each abutting surface having at least one end defining an adjoining edge with another abutting surface. Each abutting surface defines a line at each end which is disposed tangent to the abutting surface at the respective end. Each tangent line defines an acute angle with a tangent line of an adjacent abutting surface which is between approximately 1° and 10°, and preferably not greater than approximately 4°.

An advantage of the present invention is that a fiber stock delivery device having a smaller fluid discharge area can be connected with a turbulence generator having a larger fluid inlet area, without causing flow separation of the fiber stock.

Another advantage is that an existing headbox having a turbulence generator with a relatively large fluid inlet area (e.g., a diffuser with through holes or a tube bundle) can be retrofitted to a fiber stock delivery device capable of providing dilution control and/or fiber orientation.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 2:
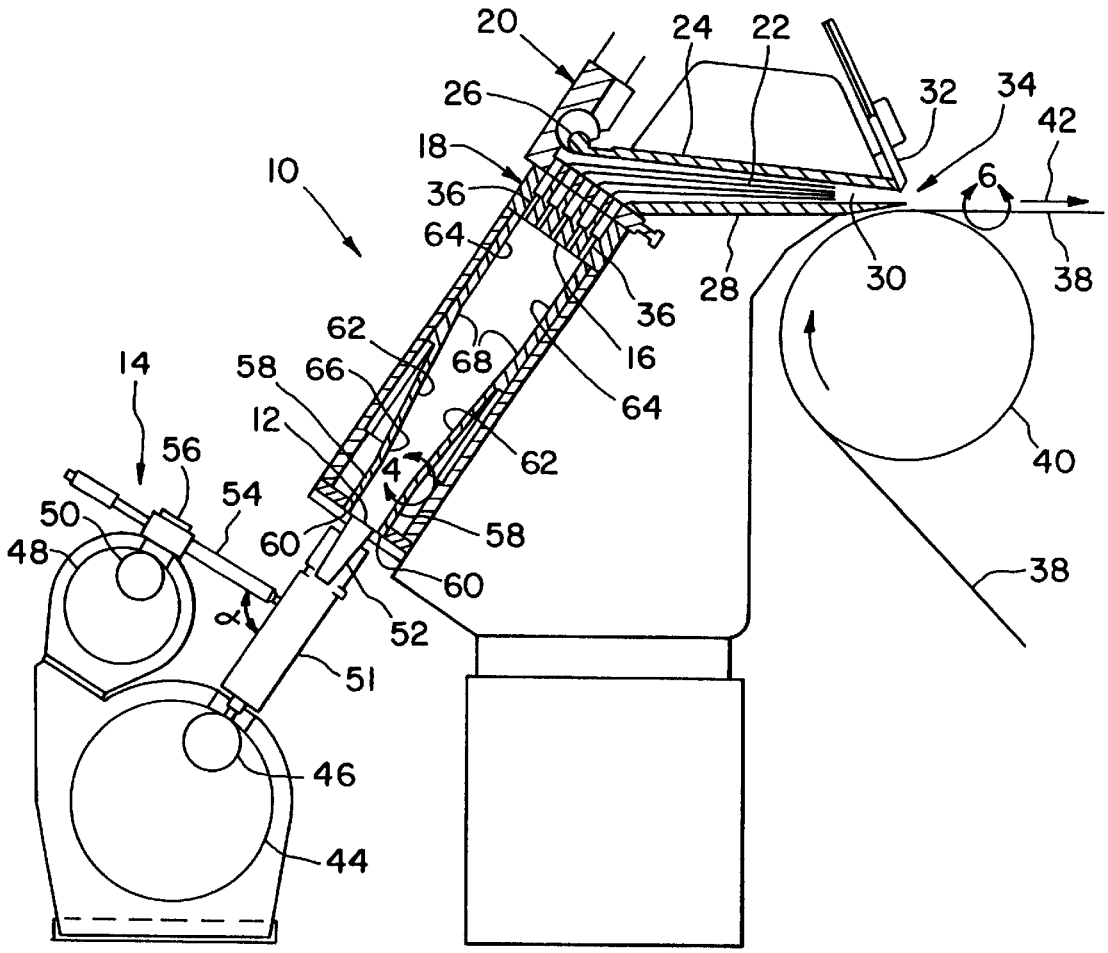
FIG. 2 is a side, sectional view of an embodiment of a hydraulic increaser of the present invention, interconnecting a smaller fluid discharge area of a fiber stock delivery device with a larger fluid inlet area of a diffuser associated with a headbox.
Figure 4:
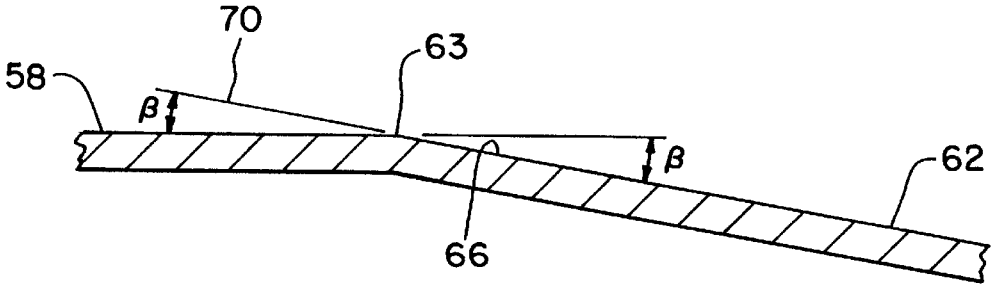
FIG. 4 is an enlarged, fragmentary view taken at detail line 4 in FIG. 2, illustrating the angular relationship between abutting surfaces in the hydraulic increaser.

Referring now to the drawings and particularly to FIGS. 2 and 4, there is shown an embodiment of a hydraulic increaser 10 of the present invention, interconnecting a smaller fluid discharge area 12 of a fiber stock delivery device 14 with a larger fluid inlet area 16 of a turbulence generator 18 associated with a headbox 20.

Headbox 20, in the embodiment shown, is a hydraulic headbox having a chamber 22 in which the fiber stock is received. Chamber 22 is defined in part by a top wall 24 which is pivotable at pivot 26. Top wall 24 and apron 28 define a discharge nozzle 30 through which the fiber stock flows. A slice lip 32 is disposed at the downstream end of top wall 24 and extends substantially across the width of headbox 20. Slice lip 32 effects fine adjustments of an outlet gap 34, while pivotable top wall 24 effects course adjustments of outlet gap 34. Headbox 20 discharges the fiber stock from outlet gap 34 onto an endless wire 38 carried by breast roll 40 and moving in the direction of arrow 42.

Turbulence generator 18 is in the form of a distributor which is integrally connected with headbox 20. Distributor 18 includes a plurality of fluid passages 36 which are disposed therein in substantially parallel relationship to each other. That is, the longitudinal axis of each fluid passage 36 is disposed substantially parallel with the longitudinal axis of any other fluid passage 36. In the embodiment shown, each fluid passage 36 includes a larger diameter portion which is disposed downstream relative to a smaller diameter portion. Each fluid passage 36 thus defines a stepped opening causing turbulence and deflocculation of the fiber stock flowing therethrough. Although each fluid passage 36 is shown with a single stepped opening, it is also possible to provide each fluid passage with multiple steps or diameters increasing in the direction of flow. Each fluid passage 36 is disposed in fluid communication with headbox chamber 22 and has an inlet (not numbered) at fluid inlet area 16. The inlets to fluid passages 36 conjunctively define fluid inlet area 16 associated with distributor 18. The spacing between the inlets to fluid passages 36 is selected such that "stapling" or buildup of the fibers in the fiber stock does not occur on the lands between the inlets. In the embodiment shown, fluid passages 36 in distributor 18 define a fluid inlet area 16 having a height extending transverse to both the flow direction and the width of tapered header 18 which is approximately 12 inches.

In the embodiment shown, fluid passages 36 are disposed in substantially aligned relationship relative to each other (i.e., aligned in a plane substantially parallel to the drawing sheet), and a plurality of similarly arranged fluid passages 36 are spaced apart across the width of distributor 18 corresponding to the width of outlet gap 34. However, fluid passages 36 may likewise be positioned equi-distantly from each other in a staggered relationship, or may be positioned in any other suitable or desirable configuration.

Fiber stock delivery device 14 is in the form of a "MODULE JET" (TM), manufactured and sold by the assignee of the present invention. However, other types of fiber stock delivery devices may be used with the present invention. Fiber stock delivery device 14 includes a first tapered header 44 for transporting headbox consistency fiber stock which has been treated for use in headbox 20. The section through the drawing in FIG. 2 is taken near the inlet end of first tapered header 44 which is of a larger diameter. First tapered header 44 tapers in known manner to an opposite end where an exit 46 of a smaller diameter is located. The taper of first tapered header 44 is selected dependent upon the flow rate therethrough such that a plurality of fluid discharges in a transverse direction have a substantially constant velocity (to be described hereinafter).

Fiber stock delivery device 44 also includes a second tapered header 48 which is of a smaller diameter than first tapered header 44, and receives and transports lean whitewater which is recirculated from the wet end of the papermaking machine. Since the lean whitewater has already been treated and is at approximately the correct temperature and Ph level, the lean whitewater may again be utilized without substantial treatment costs being incurred. Second tapered header 48 also includes a smaller diameter exit 50 which is located at the opposite end thereof corresponding in width to the opposite end of outlet gap 34.

A plurality of first tubes 51 are connected with first tapered header 44 and are disposed in spaced apart relationship relative to each other across the width of fiber stock delivery device 14. In the embodiment shown, each of first tubes 51 has an inside diameter of between approximately 1 and 1½ inches and a longitudinal axis which is spaced approximately 50 mm from a longitudinal axis of an adjacent first tube. Each first tube 50 receives a flow of the headbox consistency fiber stock from first tapered header 44 at a substantially equal velocity resulting from the tapper of first tapered header 44. First tubes 50 each join with a tapered channel 52 defining an outlet from fiber stock delivery device 14. In the embodiment shown, tapered channel 52 has a height extending transverse to both the flow direction and the width of fiber stock delivery device 14 which is approximately four inches.

A plurality of second tubes 54 are in fluid communication with each of second tapered header 48 and respective first tubes 50. A plurality of controllable valves 56 are respectively associated with each of second tubes 54 and selectively control flow of the lean whitewater from second tapered header 48 through second tubes 54. The angle $\alpha$ between the longitudinal axis of each second tube 54 and corresponding first tube 50 is selected such that the headbox consistency stock flowing through the first tube 50 is diluted with the lean whitewater flowing from the second tube 54 and mixing therewith, without a localized increase in the localized flow rate flowing from fiber stock delivery device 14. More particularly, the angle $\alpha$ may be selected such that the headbox consistency fiber stock flowing through first tube 50 is retarded to a predetermined amount at the point of mixing with the lean whitewater from the second tube 54. The fiber stock may thus be diluted while maintaining the local flow rate at a substantially constant level.

Tapered channel 52 is configured to discharge the fiber stock from fiber stock delivery device 14 in a direction which is substantially parallel to fluid passages 36 in distributor 18. More particularly, the fiber stock is discharged in a direction which is substantially parallel to the longitudinal axis of each of the fluid passages 36 in tapered header 18.

According to the present invention, hydraulic increaser 10 fluidly interconnects the fluid discharge area 12 of fiber stock delivery device 14 with the fluid inlet area 16 of distributor 18. If a simple rectangular plenum or the like were used to interconnect fiber stock delivery device 14 with distributor 18, flow separation would inevitably occur at the point which the fiber stock was transported into the rectangular plenum from fiber stock delivery device 14. Flow separation of fiber stock within a paper-making machine is undesirable because "dead spots" occur at the points of flow separation. Fibers, dirt and other particulate matter tends to buildup in these dead spots and may be carried away as clumps by the fiber stock flow. Such clumps of fibers and other particulates may ultimately travel through headbox 20 and be discharged from outlet gap 34 onto wire 38 used for forming the fiber web. Of course, such clumps of fibers or other particulates are not desirable in the finished product of the fiber web.

Hydraulic increaser 10 of the present invention is configured for substantially inhibiting flow separation of the fiber stock when the fiber stock is flowing therethrough from smaller fluid discharge area 12 of fiber stock delivery device 14 to larger fluid inlet area 16 of distributor 18. More particularly, hydraulic increaser 10 includes a pair of upstream surfaces 58, each of which has an end 60 positioned adjacent to tapered channel 52 of fiber stock delivery device 14. Upstream surfaces 58 are substantially planar and define a tangent line coincident therewith which is disposed at an acute angle with respect to the discharge direction of the fiber stock from tapered channel 52 which is not greater than approximately 10°. More particularly, in the embodiment shown in FIG. 2, each upstream surface defines a tangent line which is disposed at an angle of approximately 0° with respect to the discharge direction of the fiber stock from tapered channel 52. Thus, the phrase "acute angle" as used herein, is intended to also encompass an angle of 0°.

In general, hydraulic increaser 10 includes at least one surface which is disposed at an acute angle relative to the direction of flow immediately upstream therefrom such that flow separation does not occur. It has been observed by the present inventor that flow separation does not occur if the angle between any two adjoining surfaces within hydraulic increaser 10 is maintained at less than approximately 10°. Preferably, the acute angle between any two adjacent surfaces in hydraulic increaser 10 is not greater than approximately 7°, more preferably is not greater than approximately 5°, even more preferably ranges between approximately 1° and 5°, still more preferably is approximately 4°, and most preferably is approximately 3°.

Disposed downstream from upstream surfaces 58 are respective second abutting surfaces 62 and third abutting surfaces 64. Second abutting surfaces 62 include opposite ends 66 and 68 which define adjoining edges with upstream surface 58 and third abutting surface 64, respectively. Referring more specifically to FIG. 4, an enlarged, fragmentary view taken at detail line 4 in FIG. 2 is shown which illustrates the angular relationship between upstream surface 58 and second abutting surface 62. To wit, second abutting surface 62 defines a line 70 at end 66 which is disposed tangent to second abutting surface 62 at end 66 (with the adjoining edge being referenced as 63). Tangent line 70 defines an acute angle $\beta$ with a tangent line 72 of upstream surface 58 which is not greater than approximately 10°, preferably is not greater than approximately 7°, more preferably is not greater than approximately 5°, even more preferably ranges from between approximately 1° and 5°, still more preferably is approximately 4°, and most preferably is approximately 3°. Maintaining the angle β within the specified ranges has been found to be effective in inhibiting flow separation of the fiber stock flowing through hydraulic increaser 10. Of course, it will be appreciated that depending upon the height of the fluid discharge area 12 and the height of fluid inlet area 16, the number and/or length of abutting surfaces defining hydraulic increaser 10 may correspondingly need to vary. For example, if the height dimension of the fluid discharge area of fiber stock delivery device 14 is proportionally much smaller than the height of fluid inlet area of distributor 18, the number of abutting surfaces within hydraulic increaser 10 may need to be increased since the acute angle β between each abutting surface is not to exceed 10° to effectively inhibit flow separation of the fiber stock flowing through hydraulic increaser 10. Alternatively, if physical space permits, the length of an abutting surface within hydraulic increaser 10 may be increased which of course would result in a larger height dimension at the outlet of hydraulic increaser 10.

In the embodiment shown, hydraulic increaser 10 includes a plurality of abutting surfaces which define adjoining edges therebetween. Providing abutting surfaces with adjoining edges has been found to be preferable to using a continuous convex and/or concave surface which also does not cause flow separation. More particularly, in the very slight chance that some flow separation would occur at the adjoining edge between abutting surfaces of the present invention, the flow separation occurs at the adjoining edge substantially across the width of the hydraulic increaser, thereby ensuring some uniformity in the flow which is discharged therefrom. On the other hand, if the hydraulic increaser is configured with a simple convex curvature and some flow separation does occur, the flow separation will not occur across a line or edge extending across the width of the hydraulic increaser. Rather, the flow separation may tend to wander or meander across the width of the hydraulic increaser. Such wandering of the flow separation would not result in a consistent discharge of the fiber stock from hydraulic increaser 10. For this reason, abutting surfaces with adjoining edges therebetween are used in the present invention.

Figure 3:
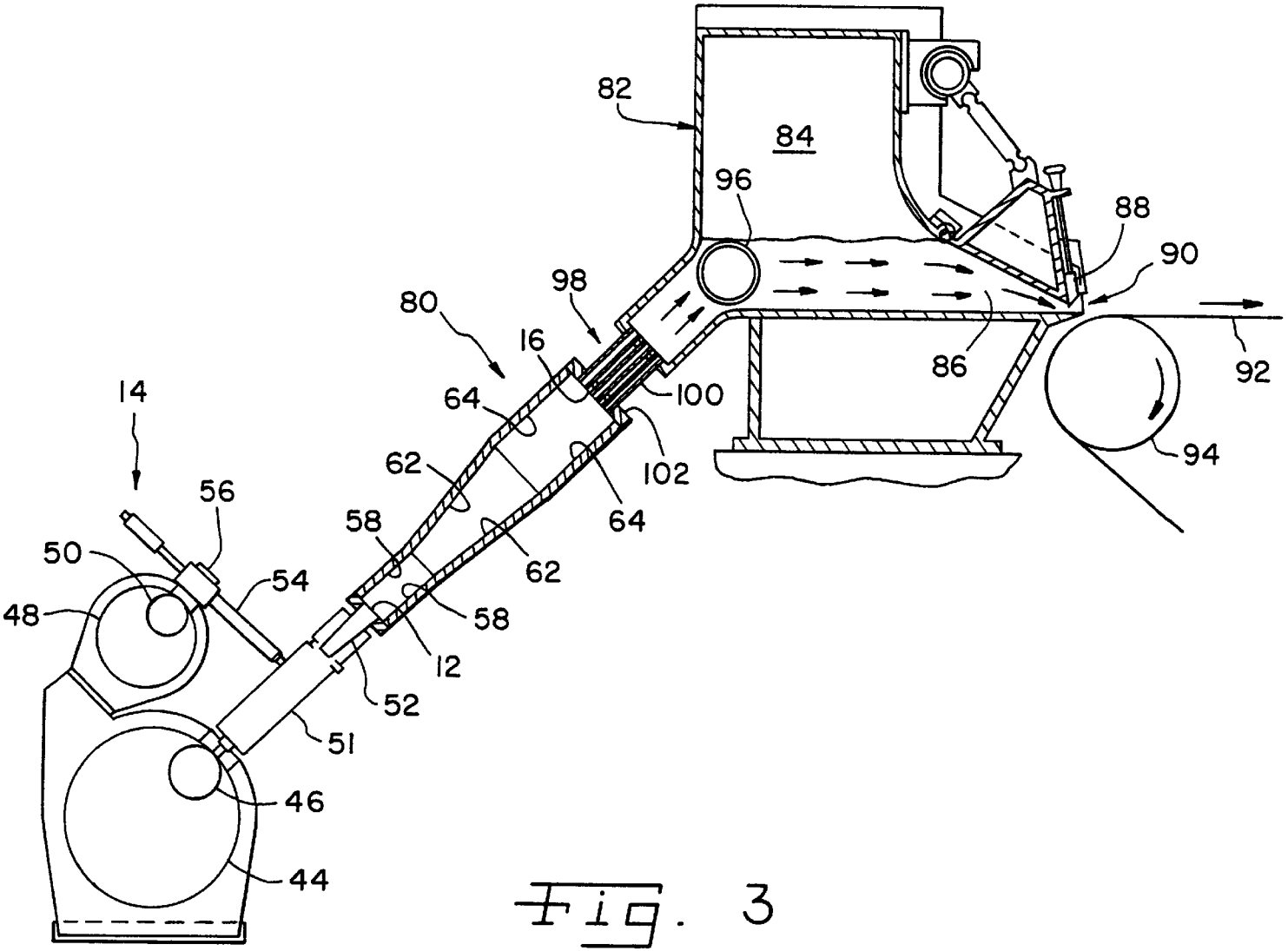
FIG. 3 is a side, sectional view of another embodiment of a hydraulic increaser of the present invention, interconnecting a smaller fluid discharge area of a fiber stock delivery device with a larger fluid inlet area of a tube bundle associated with a headbox.

Referring now to FIG. 3, there is shown another embodiment of a hydraulic increaser 80 of the present invention. Hydraulic increaser 80 fluidly interconnects fiber stock delivery device 14 with a headbox 82. Fiber stock delivery device 14 is identical to the embodiment of fiber stock delivery device 14 shown in FIG. 2, and will thus not be described in further detail.

Headbox 82 is configured as a "VALLEY" (TM) headbox, manufactured and distributed by the assignee of the present invention. Headbox 82 includes a chamber 84 and discharge nozzle 86. A slice lip 88 is disposed at the downstream end of discharge nozzle 86, and defines an outlet gap 90, through which the fiber stock is discharged onto a wire 92 carried by a breast roll 94. A distributor roll, such as a perforated distributor roll 96 is disposed within chamber 84 towards the upstream end thereof, and assists in deflocculating the fiber stock flowing through headbox 82.

A distributor 98 in the form of a tube bundle is integrally connected with headbox 82. More particularly, tube bundle 98 includes a plurality of tubes 100 which are connected to headbox 82 at one end thereof and are connected to a plate 102 at an opposite end thereof. Plate 102 is connected to the discharge end of hydraulic increaser 80. Tubes 100 are disposed a substantially equal distance from each other when viewed from the end (i.e., in a staggered or checker board relationship relative to each other). Tubes 100 assist in generating turbulence within the fiber stock flowing therethrough, and thereby assist in deflocculating the fiber stock entering headbox 82.

Hydraulic increaser 80 is substantially the same as the embodiment of hydraulic increaser 10 shown in FIG. 2. The primary structural difference is that hydraulic increaser 80 shown in FIG. 3 is not provided with additional support plates around the periphery thereof for providing support to the multiple abutting surfaces 58, 62 and 64. The angular relationships between upstream surfaces 58, second abutting surfaces 62 and third abutting surfaces 64 is the same as hydraulic increaser 10 shown in FIG. 2.

Figure 5:
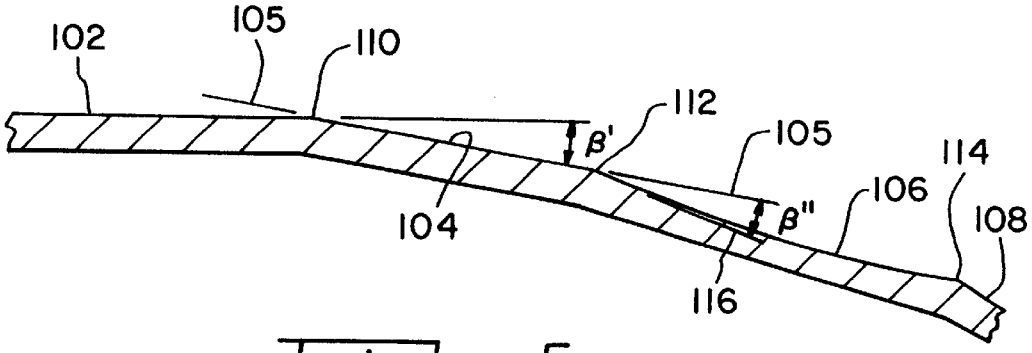
FIG. 5 is an enlarged, fragmentary view of a portion of another embodiment of a hydraulic increaser, illustrating the angular relationship between abutting surfaces in the hydraulic increaser.

Referring now to FIG. 5, there is shown an enlarged, fragmentary view of a portion of another embodiment of a hydraulic increaser of the present invention, illustrating the angular relationship between abutting surfaces in the hydraulic increaser. The hydraulic increaser shown in the fragmentary view of FIG. 5 includes an upstream abutting surface 102, second abutting surface 104, third abutting surface 106, and fourth abutting surface 108. Second abutting surface 104 includes opposite ends (not numbered) defining adjoining edges 110 and 112 with upstream abutting surface 102 and third abutting surface 106, respectively. Second abutting surface 104 defines a tangent line 105 which is disposed at an acute angle relative to upstream abutting surface 102, the complimentary angle of which is shown as β'. The angle β' is selected within the ranges specified above with regard to the angle β shown in FIG. 4.

Third abutting surface 106 is configured as a concave surface having opposite ends which define adjoining edges 112 and 114 with second abutting surface 104 and fourth abutting surface 108, respectively. Third abutting surface 106 defines a tangent line at each end thereof, one of which is referenced 116 in FIG. 5. Tangent line 116 defines an acute angle with respect to tangent line 105 extending from second abutting surface 104. The acute angle is referenced as β" and is selected within the parameters specified above with regard to the angle β shown in FIG. 4.

Although abutting surfaces 102, 104 and 108 are shown as substantially flat surfaces, and abutting surface 106 is shown as a substantially concave surface in FIG. 5, it is to be appreciated that any of the abutting surfaces within the hydraulic increaser may be configured as a substantially flat, concave and/or convex surface depending upon the particular application. For example, upstream surface 102 may be configured as a substantially flat surface which is positioned at an acute angle of less than 10° relative to the flow direction of the fiber stock discharge from fiber stock delivery device 14. Second abutting surface 104 could then be configured as a concave surface, third abutting surface 106 could be configured as a flat surface, and fourth abutting surface 108 could again be configured as a concave or convex surface.

The hydraulic increaser of the present invention provides a fiber stock delivery device with effective dilution control to be utilized in conjunction with a headbox having a turbulence generator without substantially affecting the flow characteristics of the fiber stock which is transported from the fiber stock delivery device to the headbox. A fiber stock delivery device 14 of the type described above when used in conjunction with a headbox not including a turbulence generator has been found effective to not only provide dilution control, but also to provide fiber orientation of the fiber stock which is discharged from the headbox onto the wire. Using the hydraulic increaser of the present invention, a fiber stock delivery device which provides fiber orientation may also be effectively used with a headbox having a turbulence generator with a relatively large fluid inlet area and still provide effective fiber orientation of the fiber stock on the wire.

Figure 1:
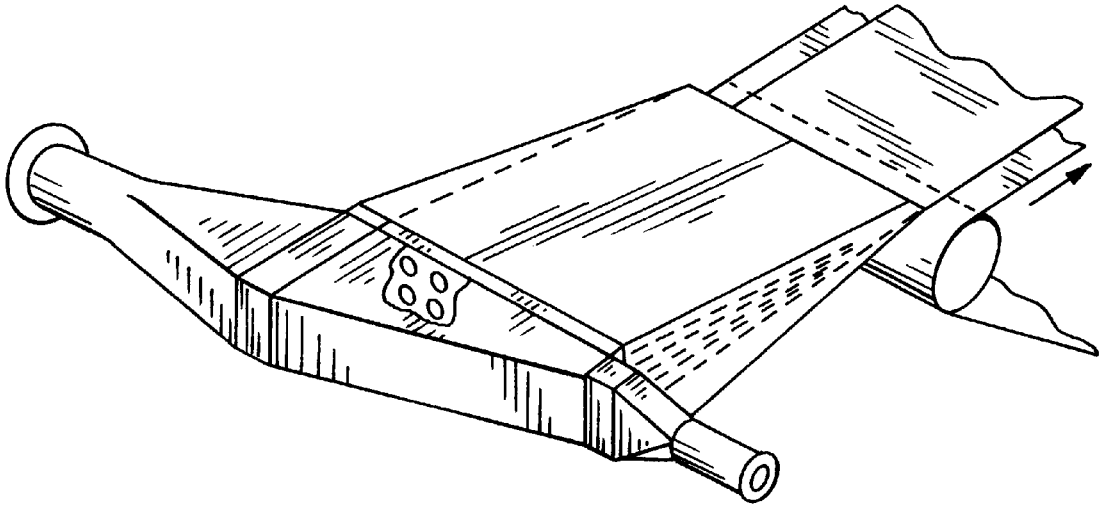
PRIOR ART Fig. 1
FIG. 1 is a fragmentary, perspective view of a portion of a prior art wet end for a paper-making machine, including a tapered header connected directly with a diffuser associated with a headbox.
Figure 6:
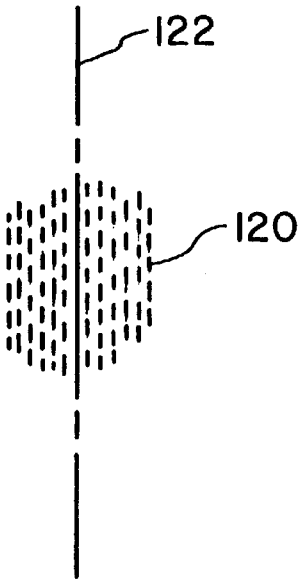
FIG. 6 is an enlarged top view taken at detail line 6 in FIG. 2, illustrating fiber orientation of the fiber stock on the wire which is possible with the present invention.

FIG. 6 is an enlarged, schematic view of the fiber stock which is discharged onto the wire as viewed from the top. As shown, a majority of the fibers 120 are oriented substantially parallel to the running direction of the wire indicated by line 122. The hydraulic increaser of the present invention thus also allows a headbox having a turbulence generator to be effectively used for providing fiber orientation of the fiber stock which is discharged onto the wire.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A wet end of a paper-making machine, comprising:

a headbox including a chamber and a discharge nozzle;

a turbulence generator connected with said headbox, said turbulence generator including a plurality of fluid passages disposed substantially parallel to each other, each said fluid passage being in fluid communication with said headbox chamber and having an inlet, all of said inlets conjunctively defining a fluid inlet area;

a fiber stock delivery device including at least one outlet, all of said outlets conjunctively defining a fluid discharge area, each said outlet being configured to discharge the fiber stock in a direction substantially parallel to said fluid passages in said turbulence generator, said fluid discharge area of said fiber stock delivery device being smaller than said fluid inlet area of said turbulence generator; and a hydraulic increaser interconnecting said fluid discharge area of said fiber stock delivery device with said fluid inlet area of said turbulence generator, said hydraulic increaser including a plurality of surfaces, at least one said surface being disposed at an acute angle relative to a direction of fluid flow immediately upstream therefrom, at least two said surfaces being abutting, at least one of said abutting surfaces being substantially concave;

wherein each of said at least one outlet of said fiber stock delivery device, said hydraulic increaser and said turbulence generator are aligned substantially parallel to one another such that a flow of the fiber stock is substantially linear.

2. The wet end of claim 1, wherein said hydraulic increaser includes an upstream surface having an end positioned adjacent to said at least one outlet of said fiber stock delivery apparatus, said upstream surface defining a line at said end which is disposed tangent to said upstream surface at said end, said tangent line defining an acute angle with respect to the discharge direction of the fiber stock delivery device which is not greater than approximately 10°.

3. The wet end of claim 1, wherein said fiber stock delivery device includes a means for providing dilution control by adjustably varying the percentage of fibers within the fiber stock.

4. The wet end of claim 3, wherein said fiber stock delivery device includes a first tapered header for transporting headbox consistency fiber stock and a second tapered header for transporting lean whitewater.

5. The wet end of claim 1, wherein said fiber stock delivery device and said hydraulic increaser conjunctively define a means for providing fiber orientation of fibers within the fiber stock when discharged from said headbox.

6. The wet end of claim 1, wherein said turbulence generator and said hydraulic increaser are integral with said headbox.

7. The wet end of claim 1, wherein said turbulence generator includes a distributor connected to said headbox, said fluid passages being disposed in said distributor.

8. The wet end of claim 1, wherein said turbulence generator includes a plurality of tubes, said plurality of tubes being connected to said headbox at one end thereof and being connected to a plate at an opposite end thereof, said hydraulic increaser being connected to said plate.

9. A wet end of a paper-making machine, comprising:

a headbox including a chamber and a discharge nozzle;

a turbulence generator connected with said headbox, said turbulence generator including a plurality of fluid passages disposed substantially parallel to each other, each said fluid passage being in fluid communication with said headbox chamber and having an inlet, all of said inlets conjunctively defining a fluid inlet area;

a fiber stock delivery device including at least one outlet, all of said outlets conjunctively defining a fluid discharge area, each said outlet being configured to discharge the fiber stock in a direction substantially parallel to said fluid passages in said turbulence generator, said fluid discharge area of said fiber stock delivery device being smaller than said fluid inlet area of said turbulence generator; and a hydraulic increaser interconnecting said fluid discharge area of said fiber stock delivery device with said fluid inlet area of said turbulence generator, said hydraulic increaser including at least two abutting surfaces, each said abutting surface having at least one end defining an adjoining edge with another said abutting surface, each said abutting surface defining a line at each said end which is disposed tangent to said abutting surface at said respective end, each said tangent line defining an acute angle with a tangent line of an adjacent said abutting surface which is not greater than approximately 10°;

wherein each of said at least one outlet of said fiber stock delivery device, said hydraulic increaser and said turbulence generator are aligned substantially parallel to one another such that a flow of the fiber stock is substantially linear.

10. The wet end of claim 9, wherein said acute angle is not greater than approximately 7°.

11. The wet end of claim 9, wherein said acute angle is not greater than approximately 5°.

12. The wet end of claim 9, wherein said acute angle is between approximately 1° and 5°.

13. The wet end of claim 12, wherein said acute angle is approximately 4°.

14. The wet end of claim 12, wherein said acute angle is approximately 3°.

15. The wet end of claim 9, wherein at least one of said abutting surfaces is a substantially flat surface.

16. The wet end of claim 9, wherein at least one of said abutting surfaces is a substantially concave surface.

17. A wet end of a paper-making machine, comprising:

a headbox including a chamber and a discharge nozzle;

a turbulence generator connected with said headbox, said turbulence generator including a plurality of fluid passages disposed substantially parallel to each other, each said fluid passage being in fluid communication with said headbox chamber and having an inlet, all of said inlets conjunctively defining a fluid inlet area;

a fiber stock delivery device including at least one outlet, all of said outlets conjunctively defining a fluid discharge area, each said outlet being configured to discharge the fiber stock in a direction substantially parallel to said fluid passages in said turbulence generator, said fluid discharge area of said fiber stock delivery device being smaller than said fluid inlet area of said turbulence generator; and a hydraulic increaser interconnecting said fluid discharge area of said fiber stock delivery device with said fluid inlet area of said turbulence generator, said hydraulic increaser including at least two interior abutting surfaces, each said abutting surface having at least one end defining an adjoining edge with another said abutting surface, each said abutting surface defining a line at each said end which is disposed tangent to said abutting surface at said respective end, each said tangent line defining an acute angle with a tangent line of an adjacent said abutting surface which is between approximately 1° and 7°;

wherein each of said at least one outlet of said fiber stock delivery device, said hydraulic increaser and said turbulence generator are aligned substantially parallel to one another such that a flow of the fiber stock is substantially linear.

18. The wet end of claim 17, wherein said acute angle is not greater than approximately 5°.

19. The wet end of claim 17, wherein said acute angle is between approximately 1° and 5°.

20. The wet end of claim 19, wherein said acute angle is approximately 4°.

21. The wet end of claim 19, wherein said acute angle is approximately 3°.

22. The wet end of claim 17, wherein at least one of said abutting surfaces is a substantially flat surface.

23. The wet end of claim 17, wherein at least one of said abutting surfaces is a substantially concave surface.

24. The wet end of claim 17, wherein said turbulence generator is integral with said headbox.

25. The wet end of claim 24, wherein said hydraulic increaser is integral with each of said turbulence generator and said headbox.

* * * * *